US012535287B2

(12) United States Patent
Barnett

(10) Patent No.: US 12,535,287 B2
(45) Date of Patent: Jan. 27, 2026

(54) CROSSBOW HAVING A PIVOTAL BOW ASSEMBLY

(71) Applicant: David A. Barnett, Tarpon Springs, FL (US)

(72) Inventor: David A. Barnett, Tarpon Springs, FL (US)

(73) Assignees: BARNETT OUTDOORS, LLC, Tarpon Springs, FL (US); David A. Barnett, Tarpon Springs, FL (US)

( * ) Notice: Subject to any disclaimer, the term of this patent is extended or adjusted under 35 U.S.C. 154(b) by 174 days.

(21) Appl. No.: 18/530,354

(22) Filed: Dec. 6, 2023

(65) Prior Publication Data

US 2024/0210140 A1 Jun. 27, 2024

Related U.S. Application Data

(60) Provisional application No. 63/435,417, filed on Dec. 27, 2022.

(51) Int. Cl.

| | |
|---|---|
| ***F41B 5/12*** | (2006.01) |
| ***F41B 5/14*** | (2006.01) |
| *F41G 1/467* | (2006.01) |

(52) U.S. Cl.

CPC ..... *F41B 5/123* (2013.01); *F41B 5/1403* (2013.01); *F41B 5/1484* (2013.01); *F41G 1/467* (2013.01)

(58) Field of Classification Search

CPC ..... F41B 5/00; F41B 5/123; F41B 5/1403; F41B 5/12; F41B 5/1484

USPC ..... 124/25

See application file for complete search history.

(56) References Cited

U.S. PATENT DOCUMENTS

| | | | | |
|---|---|---|---|---|
| 214,791 | A * | 4/1879 | Randall | F41B 5/12 124/25 |
| 5,749,348 | A * | 5/1998 | Oviedo-Reyes | F41B 5/12 124/25 |
| 11,268,782 | B1 * | 3/2022 | Chang | F41B 5/12 |
| 2020/0191518 | A1 * | 6/2020 | Egerdee | F41B 5/1403 |
| 2021/0033368 | A1 * | 2/2021 | Wong | F41B 5/14 |

* cited by examiner

*Primary Examiner* — John E Simms, Jr.
(74) *Attorney, Agent, or Firm* — Donald J. Ersler

(57) ABSTRACT

A crossbow having a crossbow frame and a bow assembly. The bow riser of the bow assembly having a launch deck surface and a bore below the launch deck surface. The crossbow frame having a launch deck surface and a coupling rod below the launch deck surface. The coupling rod is sized to cooperate with the bore, and the coupling rod is axial to and concentric with the bore. The bow riser is axially coupled to the crossbow frame by the coupling rod, the bow assembly has a first position for shooting a projectile and a second position for storage or transportation. Any suitable device may be used to lock the angular orientation between the bow assembly and the crossbow frame, such as pins, plungers, springs, detents and the like in the first and second positions.

18 Claims, 7 Drawing Sheets

CROSSBOW HAVING A PIVOTAL BOW ASSEMBLY

1. CROSS-REFERENCES TO RELATED APPLICATIONS

This is a non-provisional patent application which claims the benefit of provisional patent application no. 63/435,417, filed on Dec. 27, 2022.

2. FIELD OF THE INVENTION

The present invention relates to crossbows, and more specifically to a convertible crossbow engineered to easily convert the bow assembly from a ready-to-shoot position relative to the crossbow frame to a storage position relative to the frame.

3. DISCUSSION OF THE PRIOR ART

Historically, archery bows and crossbows have been used for war, survival, sport, and recreation. Traditionally, crossbows have been manufactured having two major assemblies combined into one: the bow assembly and the frame assembly. The bow assembly generally has a riser, limbs, and a bowstring. The bow assembly may also include cams, cables, limb pockets, and other required components to make the bow assembly functional. The frame assembly traditionally has a stock, a rail, a grip, a trigger assembly, and provisions for aiming the crossbow. The two assemblies were then joined together to make a functional crossbow.

Historically, crossbows have been designed and assembled without taking into account the need for smaller packaging and transportation requirements. Typically, a very large box or case was required to ship or transport a completely assembled crossbow, which is undesirable. When assembled, crossbows have a vertical volume, and a horizontal volume. The vertical volume can be made up of the width and height of the crossbow frame, grip, butt stock, and scope, while the horizontal volume can be made up from the bow assembly and crossbow frame. The vertical volume component can be as much as twelve inches or more from the bottom of the hand grip to the top of the scope, and the horizontal volume can be as much as twenty-four inches or more for the width of the bow assembly. During shipping or transportation, the assembled crossbow would require packing that encompassed the entire volume of width and height, having much wasted space within the confines of the package. An example of this could be a crossbow bow assembly that is twenty-four inches wide, twelve inches from the front of the riser to the rear of the cam, and four inches high. The crossbow frame has an overall length of thirty-two inches, four inches in width, and twelve inches in height. Some of these volumes overlap each other in the central portion of the bow assembly, and will be accounted for. In the standard configuration, this crossbow would need a package with the interior volume dimensions of at least twenty-four by twelve by thirty-two inches, with a minimum volume of nine thousand two hundred sixteen cubic inches. The disclosure allows for a smaller volume in packaging and transportation of four thousand six hundred eight cubic inches, or a reduction of fifty percent cubic volume.

More recently, Excalibur designed a crossbow that had a bow assembly completely removable from the crossbow frame, but this required tools and much time and effort to disassemble and reassemble the crossbow for use.

There is clearly a need for a crossbow that may be easily converted from a ready-to-use configuration to a smaller easier to store configuration, and back again.

SUMMARY OF THE INVENTION

The crossbow set forth within shall have the typical components of a bow assembly including a riser and bow limbs or energy storage components, and a bowstring operably coupled with the limbs. A crossbow frame includes a trigger, a sight a string catch selectable from a first position holding a bowstring and a second position releasing the bowstring, the string catch operably coupled to the trigger, and a grip portion for the user to hold the crossbow when in use. The bow assembly may be those known in the art such as recurve or compound bow assemblies.

The crossbow of the disclosure will also be described and referred to the use and handling of traditional crossbows having the bowstring in a substantially horizontal orientation when shooting the crossbow. The disclosure is not to be confused with a vertical crossbow, wherein the bowstring is in a more or less vertical orientation when shooting the crossbow.

The bow assembly and the crossbow frame combine to make the crossbow. All references to vertical and horizontal shall be made when the crossbow is being held in a shooting position with the launch deck and arrow level front to back and the bow assembly level side to side. Crossbows may have a guide rail for the bowstring and arrow, or be of the rail-less configuration. Though the disclosure may be utilized by any style of crossbow, for the sake of clarity a crossbow having a rail and a launch deck will be described herein.

The bow assembly of the disclosure has a first position and a second position relative to the crossbow frame. The bowstring of the disclosure has a first orientation and a second orientation relative to the crossbow frame. When the bow assembly is in the first position relative to the crossbow frame, the bowstring may be drawn from the uncocked (first) position to the cocked (second) position. When the bow assembly is in the second position relative to the crossbow frame, the bowstring cannot be moved from the first position of the bowstring to the second position of the bowstring. The bowstring of the crossbow in this disclosure has the same first position relative the bow assembly when the crossbow is uncocked and when the bow assembly is rotated into the stored position. The first position of the bowstring relative to the crossbow frame when the crossbow is uncocked is more or less horizontal and perpendicular to the flight deck rail. When the bow assembly is in the second position relative to the crossbow frame, the bowstring is in the second orientation relative to the crossbow frame, but still in the first position relative to the bow assembly. This second orientation of the bowstring relative to the crossbow frame is substantially vertical, and the bowstring is incapable of being moved from the bowstring first position to the bowstring second position.

This is very important as to differentiate the disclosure from the prior art of a vertical crossbow. A vertical crossbow has the bowstring in a substantially vertical orientation when the bowstring is in a first position (uncocked) and a second position (cocked). The bowstring catch is positioned to selectively retain or release the bowstring from this vertical orientation of the bowstring.

The "crossbow," may have limbs that are solid or split, or other energy storage components such as springs or pistons. The "crossbow" shall have a bowstring, and may have at least one power cable. The "crossbow" may have a rail that the bowstring engages, or of the rail-less design. The crossbow may be of conventional draw, conventional draw with reverse cams, or reverse draw. The "crossbow" may or may not have a built-in cocking aid. The "crossbow" will have a bowstring retainment and release mechanism. The "crossbow" may be a conventional shoulder fired device or a pistol.

The term "limb" may refer to what are known as solid limbs, split-limbs, tube-limbs, or any other energy storing component.

For clarity, the word "coupled" is being defined as-a-way-to connect an object, such as a bowstring or cable, with another object, be it directly or indirectly, such as directly to a post or pulley, or indirectly as in from the end of a string or cable, to an intermediate object, and then to a limb or axle.

The term "rail" is used as a general term describing an elongated component that directly or indirectly supports the front of an arrow. "Rail-less" crossbows still have an elongated component that is coupled with a riser or other structure, wherein the elongated component directly or indirectly supports the front of an arrow.

The term "riser" is a component or structure the "limbs" are coupled too.

Accordingly, there is a clearly felt need in the art for a crossbow that has a bow assembly that is selectively movable from a first position relative to the crossbow frame for use, and a second position relative to the crossbow frame for packaging or transport.

These and additional objects, advantages, features and benefits of the present invention will become apparent from the following specification.

DETAILED DESCRIPTION OF THE PREFERRED EMBODIMENTS

Figure 1:
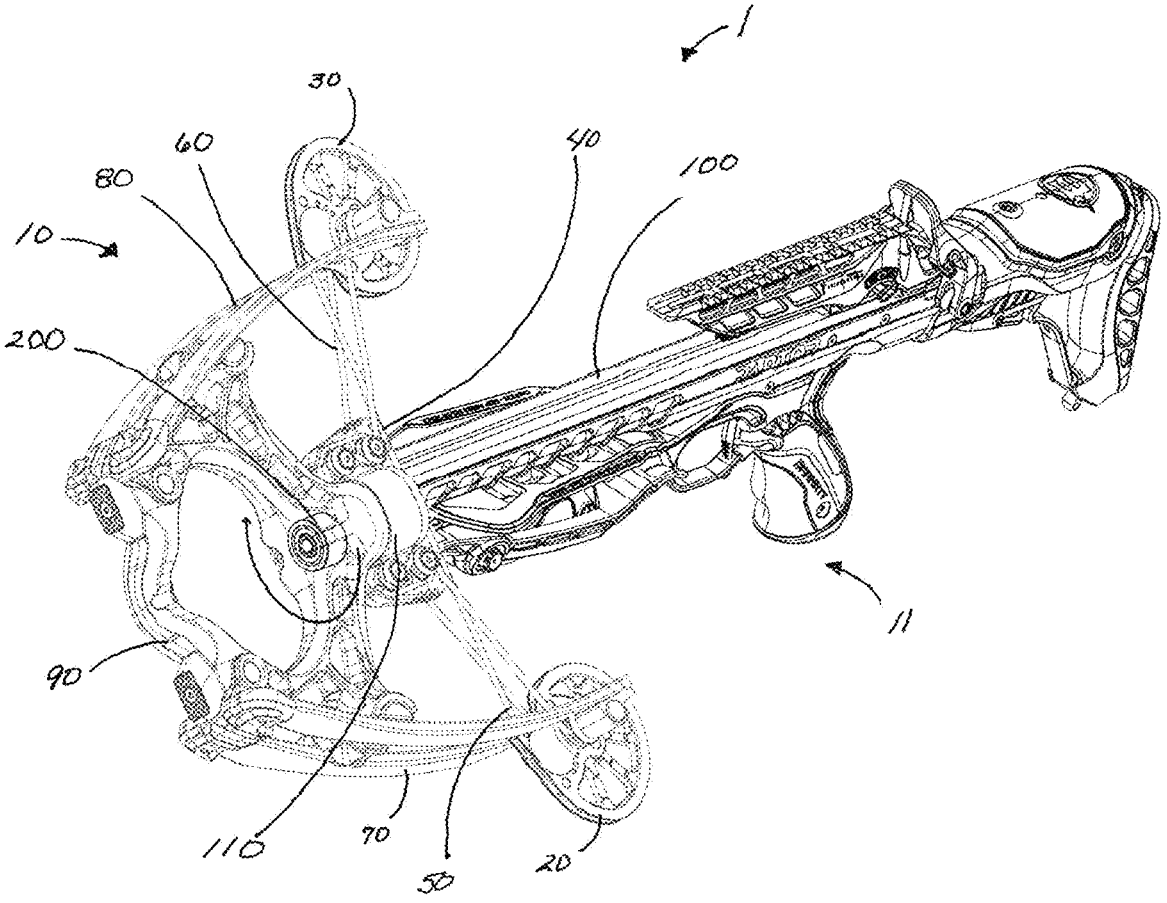
FIG. 1 is a perspective view of a crossbow having the bow assembly partially rotated, mid-way between the first position and the second position relative to the crossbow frame in accordance with the present invention.
Figure 2:
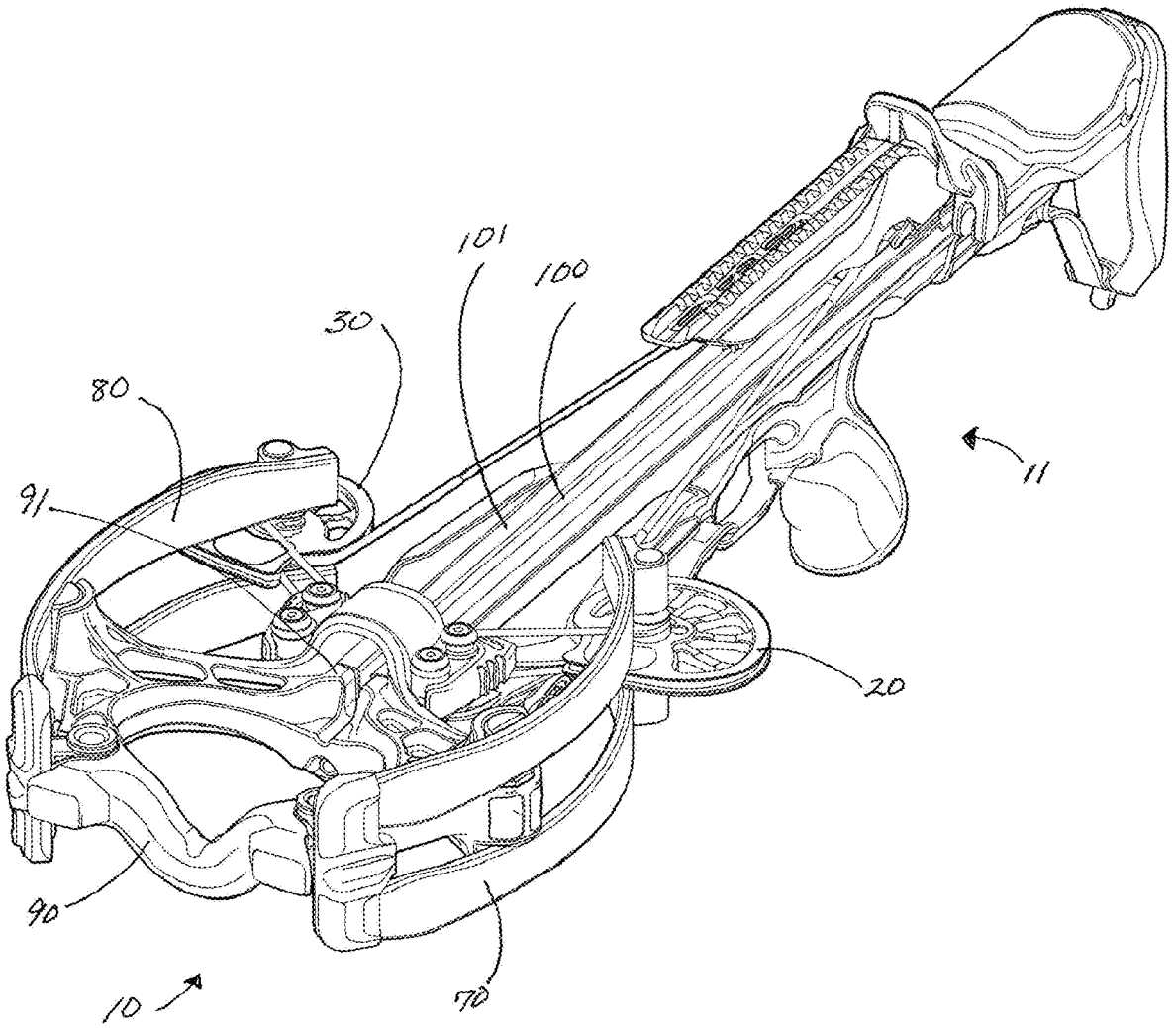
FIG. 2 is a perspective view of a crossbow having the bow assembly in the first position relative the crossbow frame in accordance with the present invention.
Figure 3:
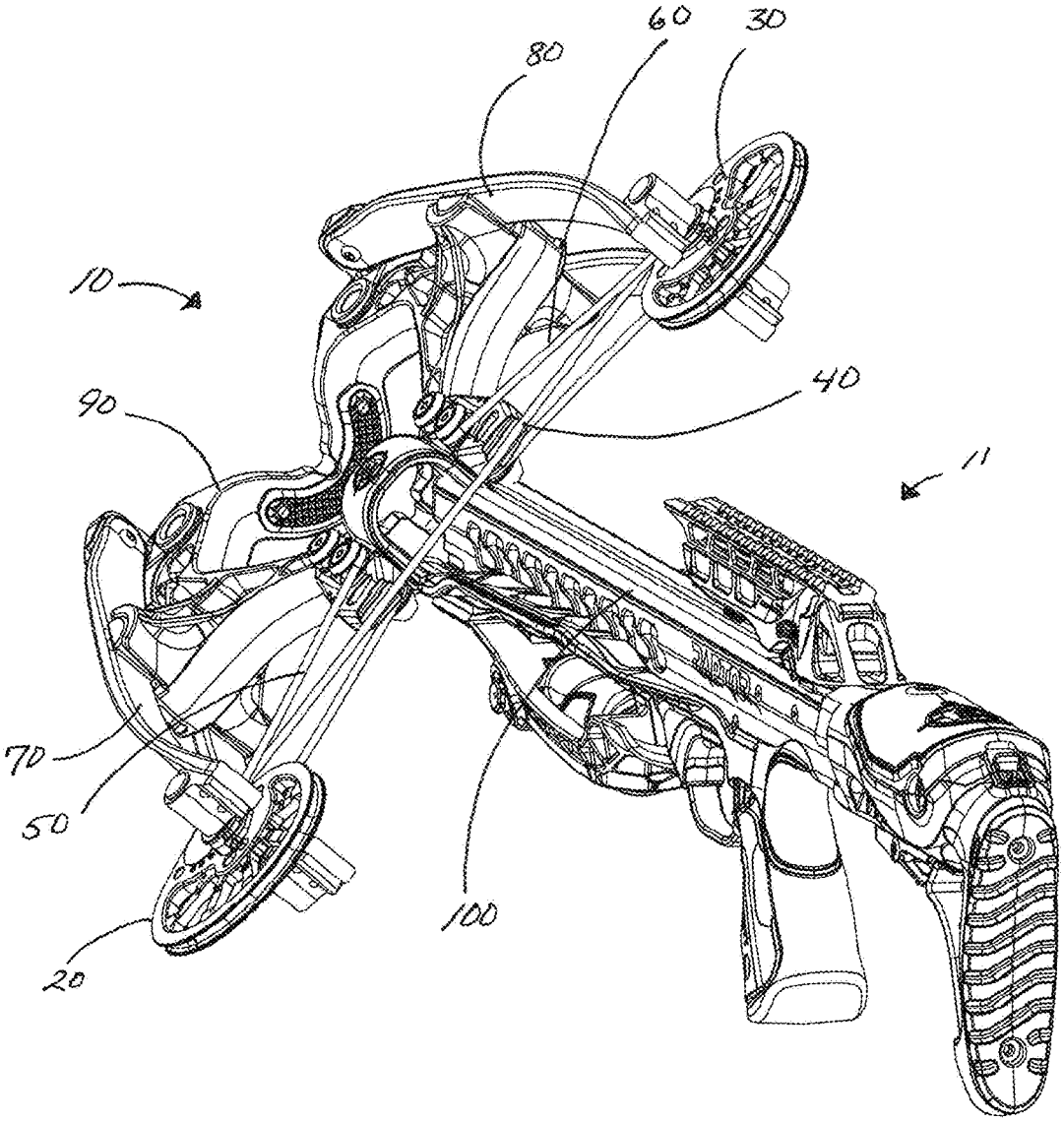
FIG. 3 is a perspective view of a crossbow having the bow assembly partially rotated, mid-way between the first position and the second position relative to the crossbow frame in accordance with the present invention.
Figure 4:
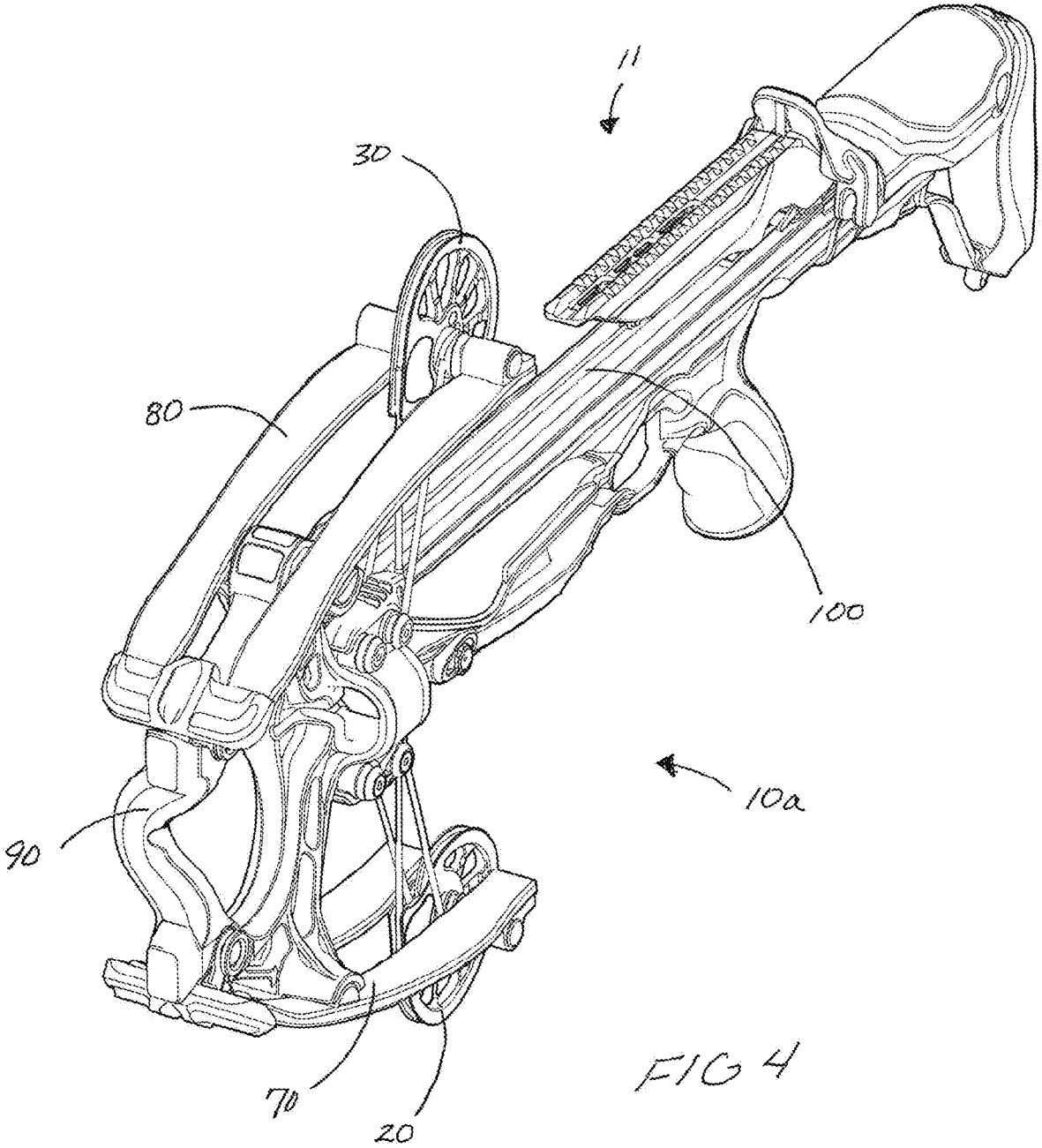
FIG. 4 is a perspective view of a crossbow having the bow assembly partially rotated to the second position relative to the crossbow frame in accordance with the present invention.
Figure 5:
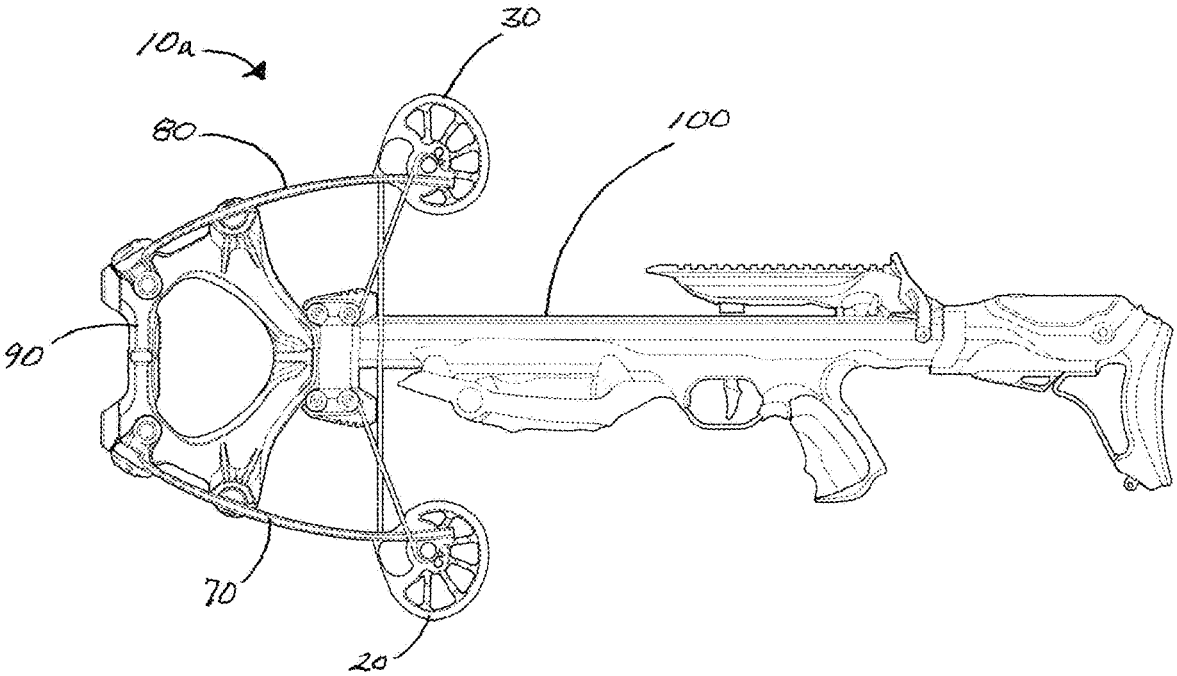
FIG. 5 is a side view of a crossbow having the bow assembly partially rotated to the second position relative the crossbow frame in accordance with the present invention.
Figure 6:
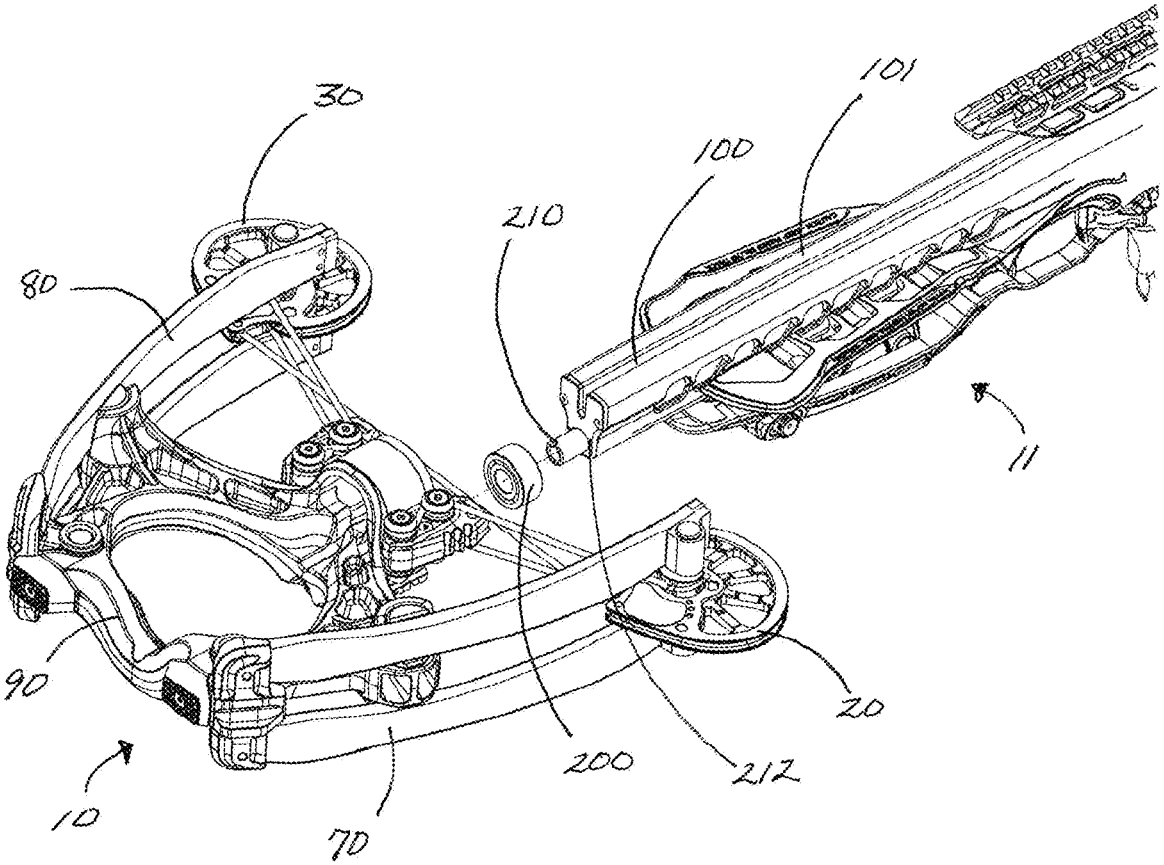
FIG. 6 is a partially exploded perspective view of a crossbow having the bow assembly in the first position relative the crossbow frame in accordance with the present invention.
Figure 7:
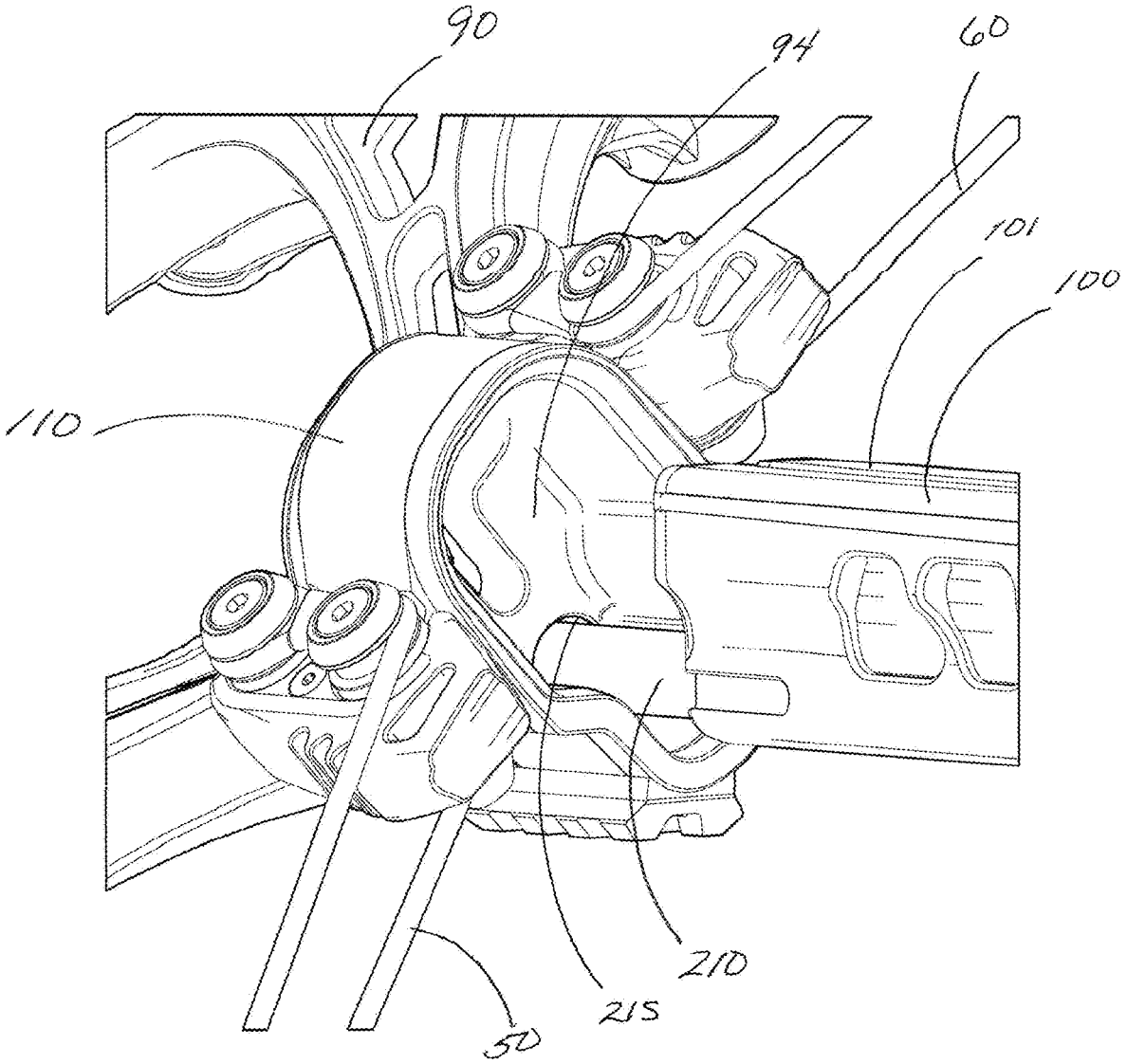
FIG. 7 is a partially exploded perspective view of a crossbow having the bow assembly partially rotated, mid-way between the first position and the second position in the first position relative the crossbow frame in accordance with the present invention.

Referring to the figures of the preferred embodiment, the bow assembly 10 and the crossbow frame 11 combine to make the crossbow 1. The crossbow frame 11 may have a guide rail 100 for the bowstring 40 and arrow (not shown), or be of the rail-less configuration.

The bow assembly 10 of the disclosure has a first position and a second position 10*a* relative to the crossbow frame 11. The bowstring 40 of the disclosure has a first orientation and a second orientation relative to the crossbow frame 11. When the bow assembly 10 is in the first position relative to the crossbow frame 11, the bowstring 40 may be drawn from the uncocked (first) position to the cocked (second) position of the bowstring 40. When the bow assembly 10 is in the second position 10*a* relative to the crossbow frame 11, the bowstring 40 cannot be moved from the first position of the bowstring to the second position of the bowstring 40. The bowstring 40 of the crossbow 1 in the disclosure has the same first position relative to the bow assembly 10 when the crossbow 1 is uncocked and when the bow assembly 10 is rotated into the second position 10*a*. This first position of the bowstring 40 relative to the crossbow frame 11 when the crossbow 1 is uncocked is substantially horizontal and perpendicular to the guide rail 100. When the bow assembly 10 is in the second position 10*a* relative to the crossbow frame 11, the bowstring 40 is in the second orientation relative to the crossbow frame 11, but still in the first position relative to the bow assembly 10. This second orientation of the bowstring 40 relative to the crossbow frame 11 is substantially vertical, and the bowstring 40 is incapable of being moved from the bowstring first position to the bowstring second position.

The center portion of the bow assembly riser 90 has a launch deck surface 91, and a bore 215 sized to receive a coupling rod 210. The crossbow frame 11 has a launch deck surface 101, and a bore 212 sized to receive the coupling rod 210. The bore of the riser 215 and the bore of the crossbow frame 212 are axial to one another. The coupling rod 210 is axially retained within the bore 215 of the riser 215 and the crossbow frame 212. The coupling rod 210 is located below the launch deck surface 101. A bearing 200 is preferably pressed into a bearing bore (not shown) in the bow assembly riser 90. The bearing 200 is sized to rotatably receive the coupling rod 210. A bearing bore may also be formed in the cross frame 11 instead of the bow assembly riser 90. The coupling rod 210 is normally retained in cross frame 212, but would be retained in the bow assembly riser 90, if the bearing bore is formed in the cross frame 212.

When the crossbow 1 is in the ready-to-be-used configuration, the bow assembly 10 is in the first position relative the crossbow frame 11, the launch deck surface 91 of the riser 90 is coplanar with the launch deck surface 101 of the crossbow frame 11. Further, the movement of the center of the bowstring 40 from the bowstring first position to the bowstring second position is on the same plane or parallel this plane. Subsequently, the "plane" will be referred to as the "launch plane." The launch plane may be defined by a surface that the bowstring 40 is in contact with the (launch deck surface 101), or it may also be simply the path of the bowstring 40 between the bowstring first and second positions, wherein the bowstring 40 does not come in contact with the surface. Further, the launch deck surface 91 of the riser 90 may be a place of reference only, and may be substituted by an arrow rest that would position the front of the arrow (projectile) in the exact same position relative the launch plane.

When the bow assembly 10 is in the second position 10*a* relative to the crossbow frame 11, the launch deck surface 91 of the riser 90 is not on the same plane as the launch deck surface 101 of the crossbow frame 11. In the preferred embodiment, the launch deck surface 91 of the riser 90 shall be offset from and more or less perpendicular to the launch deck surface 101 of the crossbow frame 11. A bow assembly retainment component selectively retains the bow assembly 10 in the first position relative the crossbow frame 11 while the crossbow 1 is in use, and may selectively retain the bow assembly 10 in the second position 10*a* relative the crossbow frame 11 while the crossbow 1 is being transported or stored. As the bow assembly 10 is rotated from the first position to the second position 10*a*, the bow assembly 10 transitions from a substantial horizontal orientation to a substantial vertical orientation, while the crossbow frame 11 remains in a substantially vertical orientation.

In a first preferred embodiment, the compound bow assembly 10 having a crossbow cable hub 110 and cable retainment means, and functionally coupling the crossbow riser 90 with the crossbow frame 11, wherein the cable hub collar is structural at least three hundred degrees about the circumference of the axis of the arrow, and preferably structural three hundred sixty degrees about the circumference of the arrow.

The riser 90 of the bow assembly 10 may have a crossbow frame mating surface 94, and a bore 215 to receive a coupling rod 210. The distal end of the crossbow frame 11 may have a bore 212 to receive the coupling rod 210, and a riser mating surface. The coupling rod 210, the riser bore 215 and the crossbow frame bore 212 are concentric. The riser bore 215 and the crossbow frame bore 212 are axially coupled with the coupling rod 210. The mating surfaces of the end of the crossbow frame 11 and the riser 90 are adjacent each other with a tight tolerance while the bow assembly 10 is in the first position. The cooperation between the bow assembly 10 and the crossbow frame 11 may be that of any known in the arts, as there are many known means to selectively radially retain a first object (bow assembly 10) with a second object (crossbow frame 11) such as pins, plungers, springs, detents and so on to lock the angular position of the crossbow frame 11 relative to the bow assembly 10 in the first and second positions. The bow assembly 10 may be radially retained in the first position by the known means, the user selectively interacts with the known means to release the bow assembly 10 from the first position, and initiates rotation of the bow assembly 10 to the second position 10*a*, and the known means retains the bow assembly 10 in the second position 10*a*. Further, the riser mating surface 94 and the mating surface of the crossbow frame 11 may retain the tight rotational tolerance when the bow assembly is in the first position and the second position 10*a*, or the riser mating surface 94 may separate from the mating surface of the end of the crossbow frame 11 as the bow assembly 10 is rotated from the first position relative the crossbow frame 11 to the second position 10*a*, and the bow assembly 10 stays axially coupled with the crossbow frame 11.

In an alternate embodiment, a coupling rod or coupling boss may be integrated with the crossbow frame, such as part of an extrusion, molding, or casting; or the coupling rod coupling boss may be integrated with the riser.

The arrow when supported by the crossbow 1 as defined by its position on the launch deck 101 of the crossbow 1. This longitudinal axis is also centered on the mid-point of the bowstring.

In an alternate embodiment, the bow assembly may be that of a recurve-style crossbow. In another alternate embodiment, the crossbow may be a pistol or one-handed use crossbow.

Accordingly, there is a clearly felt need in the art for a crossbow that has a bow assembly that is selectively movable from a first position relative to the crossbow frame for use, and a second position relative to the crossbow frame for transport.

Though specific descriptions outline the preferred embodiments, alterations to the invention that alter only the component type or cooperation and not the alter function or desired result thereof fall within the scope of the claims of the embodiment.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A crossbow having a crossbow frame and a bow assembly, comprising:

the bow assembly having bow limbs coupled to a bow riser and a bowstring operably coupled to said bow limbs, the bow riser having a riser launch deck surface and a riser bore; and the crossbow frame having a frame launch deck surface and a frame bore below the frame launch deck surface, one end of a coupling rod is retained in the frame bore, an opposing end of the coupling rod is retained in said riser bore, the bow assembly rotates relative to the crossbow frame through the coupling rod, the bow riser axially coupled to the crossbow frame by the coupling rod, the bow assembly having a first position relative to the crossbow frame for shooting a projectile and a second position relative the crossbow frame for storage or transportation, wherein the first position of the riser launch deck surface is co-planar with the frame launch deck surface, and in the second position the riser launch deck surface is substantially perpendicular to the frame launch deck surface, wherein the bow assembly is selectively retained in the first position or selectively retained in the second position, wherein the crossbow frame and the bow assembly remain in contact with the coupling rod, when the bow assembly is moved from the first position to the second position, or moved from the second position to the first position, wherein the bow assembly and the crossbow frame remain axially coupled to each other.

2. The crossbow of claim 1, wherein:

the crossbow is capable of shooting a projectile when the bow assembly is in the first position relative to the crossbow frame and not capable of shooting a projectile when the bow assembly is in the second position relative to the crossbow frame.

3. The crossbow of claim 1, wherein:

a crossbow sight is located above a crossbow trigger, and the bowstring is located on a horizontal plane between the trigger and the sight.

4. The crossbow of claim 1, wherein:

the bow assembly is selectively radially retained on the crossbow frame in a first position for shooting a projectile and selectively radially retained in the second position for transporting the crossbow.

5. The crossbow of claim 1, further comprising:

a locking device for preventing rotation of said bow assembly relative to said crossbow frame.

6. The crossbow of claim 1, further comprising:

a bearing is pressed into a bearing bore in said bow riser, said bearing is sized to receive said coupling rod.

7. A crossbow having a crossbow frame and a bow assembly, comprising:

a bow riser of the bow assembly having a riser launch deck surface; and the crossbow frame having a frame launch deck surface one end of a coupling rod is retained in the crossbow frame, an opposing end of the coupling rod is retained in the bow assembly, the bow assembly rotates relative to the crossbow frame through the coupling rod, the bow assembly having a first position relative to the crossbow frame for shooting a projectile and a second position relative to the crossbow frame for storage or transportation, wherein the first position of the riser launch deck surface is co-planar with the frame launch deck surface, the second position of the riser launch deck surface is substantially perpendicular to the launch deck surface of the crossbow frame, wherein the bow assembly is selectively retained in the first position or selectively retained in the second position, the crossbow frame and the bow assembly remain in contact with the coupling rod, when the bow assembly is moved from the first position to the second position, or moved from the second position to the first position, wherein the bow assembly and the crossbow frame remain axially coupled to each other.

8. The crossbow of claim 7, wherein:

the crossbow is capable of shooting the projectile when the bow assembly is in the first position relative to the crossbow frame and not capable of shooting the projectile when the bow assembly is in the second position relative to the crossbow frame.

9. The crossbow of claim 7, wherein:

a crossbow sight is located above a crossbow trigger, wherein a bowstring is located on a horizontal plane between the trigger and the sight.

10. The crossbow of claim 7, wherein:

the bow assembly is selectively radially retained on the crossbow frame in a first position for shooting the projectile and selectively radially retained in the second position for transporting the crossbow.

11. The crossbow of claim 7, further comprising:

a locking device for preventing rotation of said bow assembly relative to said crossbow frame.

12. The crossbow of claim 7, further comprising:

a bearing is pressed into a bearing bore in said bow riser, said bearing is sized to receive said coupling rod.

13. A crossbow having a crossbow frame and a bow assembly, comprising:

a bow riser of the bow assembly having a riser launch deck surface and a coupling rod located below the riser launch deck surface; and the crossbow frame having a frame launch deck surface, one end of a coupling rod is retained in the crossbow frame, an opposing end of the coupling rod is retained in the bow assembly, the bow assembly rotates relative to the crossbow frame through the coupling rod, the bow assembly having a first position relative the crossbow frame for shooting a projectile and a second position relative the crossbow frame for storage or transportation, wherein the first position of the riser launch deck is co-planar with the frame launch deck surface, the second position of the riser launch deck surface is substantially perpendicular to the frame launch deck surface, wherein the bow assembly is selectively retained in the first position or the second position, the crossbow frame and the bow assembly remain in contact with the coupling rod, when the bow assembly is moved from the first position to the second position, or moved from the second position to the first position, wherein the bow assembly and the crossbow frame remain axially coupled to each other.

14. The crossbow of claim 13, wherein:

the crossbow is capable of shooting the projectile when the bow assembly is in the first position relative to the crossbow frame and not capable of shooting the projectile when the bow assembly is in the second position relative to the crossbow frame.

15. The crossbow of claim 13, wherein:

a crossbow sight is located above a crossbow trigger, wherein a bowstring is located on a horizontal plane between the trigger and the sight.

16. The crossbow of claim 13, wherein:

the bow assembly is selectively radially retained on the crossbow frame in the first position for shooting the projectile and selectively radially retained in the second position for transporting the crossbow.

17. The crossbow of claim 13, further comprising:

a locking device for preventing rotation of said bow assembly relative to said crossbow frame.

18. The crossbow of claim 13, further comprising:

a bearing is pressed into a bearing bore in said bow riser, said bearing is sized to receive said coupling rod.

* * * * *